US005303582A

United States Patent [19]

Miska

[11] Patent Number: 5,303,582

[45] Date of Patent: Apr. 19, 1994

[54] PRESSURE-TRANSIENT TESTING WHILE DRILLING

[75] Inventor: Stefan Miska, Tulsa, Okla.

[73] Assignee: New Mexico Tech Research Foundation, Socorro, N. Mex.

[21] Appl. No.: 969,100

[22] Filed: Oct. 30, 1992

[51] Int. Cl.[5] ..... E21B 47/00

[52] U.S. Cl. ..... 73/155; 166/250; 175/48; 175/25

[58] Field of Search ..... 73/155; 166/250; 175/40, 48, 25

[56] References Cited

U.S. PATENT DOCUMENTS

| | | | |
|---|---|---|---|
| 3,443,643 | 5/1969 | Jones | 175/25 |
| 4,253,530 | 3/1981 | Sharki et al. | 175/48 |
| 4,310,058 | 1/1982 | Bourgoyne, Jr. | 175/48 |
| 4,527,425 | 7/1985 | Stockton | 175/48 |
| 4,606,415 | 8/1986 | Gray, Jr. et al. | 175/48 |
| 4,733,232 | 3/1988 | Grosso | 175/48 |
| 4,805,449 | 2/1989 | Das | 73/151 |
| 4,867,254 | 9/1989 | Gavignet | 175/48 |
| 4,879,654 | 11/1989 | Bruce | 175/48 |
| 5,006,845 | 4/1991 | Calcar et al. | 175/48 |
| 5,080,182 | 1/1992 | Thompson | 175/48 |

OTHER PUBLICATIONS

"Pressure-Transient Testing at Drilling Stage of Well Development" by S. Miska et al., Society of Petroleum Engineers, SPE Asia-Pacific Conference, pp. 585-595 (Nov. 4-7, 1981).

*Primary Examiner*—Robert J. Warden
*Assistant Examiner*—Hien Tran
*Attorney, Agent, or Firm*—Dennis F. Armijo

[57] ABSTRACT

A well testing method and apparatus for reservoir characterization during a drilling operation by making use of conventional drilling facilities. The tests can be performed at various degrees of wellbore penetration in the formation. If the test is conducted as soon as the top of the formation is penetrated by the bit, the effects of formation damage (skin) may be minimized or even eliminated. The proposed technique is particularly suitable for formations displaying weak pore structure, tight formation, and/or relatively low reservoir pressure. The method consists of two major steps; a drawdown test with a variable rate, and a build up test. A computer simulator is necessary and also useful for pressure transient analysis for determination of reservoir pressure and transmissibility. From the data recorded from a single well test utilizing this method and apparatus, fluid mobility and formation thickness can be calculated.

20 Claims, 3 Drawing Sheets

PRESSURE-TRANSIENT TESTING WHILE DRILLING

GOVERNMENT RIGHTS

The U.S. Government has a paid-up license in this invention and the right in limited circumstances to require the patent owner to license others on reasonable terms as provided by the terms of Allotment Grant Number G1164135 awarded by the Department of Interior's Mineral Institute program administered by the Bureau of Mines.

BACKGROUND OF THE INVENTION

1. Field of the Invention (Technical Field):

The invention relates to a method and apparatus for predicting reservoir inflow performance and more particularly to a testing method and apparatus for determining horizontal and vertical permeabilities during any stage of a drilling operation.

2. Background Art

The occurrence of heterogeneity in reservoir formations is one of the major problems confronting engineers in the design of well completion configuration and stimulation treatments. Projects undertaken without sufficiently detailed reservoir evaluations, and, in particular, without knowledge of vertical and horizontal permeabilities, are risky. Tests such as drill stem test (DST) and repeat formation test (RFT) may provide useful information for predicting well inflow performance, but require special equipment and are costly. Also, conventional single well pressure transient tests do not provide information on vertical and horizontal permeability.

SUMMARY OF THE INVENTION

(DISCLOSURE OF THE INVENTION)

The present invention relates to a method and apparatus for determining a reservoir inflow performance of a well that is performed during the drilling stage. The technology described here significantly reduces the cost and time in determining reservoir inflow from conventional methods. In addition, horizontal and vertical permeabilities can be determined utilizing this method. This testing method and apparatus are particularly suitable for formations displaying weak pore structures at a relatively low formation pressure.

In accordance with the present invention, there is provided a method of pressure transient testing at the drilling stage of well development, the method comprising the steps of providing bottom hole pressure lower than a formation pressure; determining a formation fluid rate; shutting in the well; determining a bottom hole pressure and calculating a reservoir inflow. The preferred step of providing bottom hole pressure lower than formation pressure comprises inducing a drawdown. The preferred step of inducing a drawdown comprises pumping down a drill pipe and up an annulus an inducing fluid with a density less than a drilling fluid while obtaining a predetermined amount of reservoir fluid from the annulus.

The preferred step of inducing a drawdown comprises pumping down a drill pipe and up an annulus an inducing fluid with a density less than a drilling fluid while approaching a formation; stopping a flow of the drilling fluid as the inducing fluid enters the annulus to maintain a pressure overbalance at a bottom hole; ceasing drilling when the formation is encountered; pumping additional inducing fluid into the annulus; and releasing an annular pressure and admitting a predetermined amount of reservoir fluid into the annulus. The preferred step of stopping a flow of the drilling fluid comprises stopping the flow at a surface. The alternative step of stopping a flow of the drilling fluid comprises stopping the flow at a bottom hole. The preferred step of releasing an annular pressure comprises releasing a casing choke and a blowout preventer.

The preferred step of shutting in the well comprises closing blowout preventers and casing chokes. The step of determining a bottom hole pressure preferably comprises measuring a bottom hole pressure. The alternative step of determining a bottom hole pressure comprises measuring a pressure at predetermined locations and calculating a downhole pressure. The preferred calculating step comprises deriving a mathematical model to predict pressure conditions at preselected stages of a test and utilizing a computer simulator based on the mathematical model. The preferred step of utilizing a computer simulator further comprises predicting a flowing and shut-in bottom hole pressure and flow rate when reservoir and wellbore data are known. The step of utilizing a computer simulator can further comprise predicting reservoir pressures and permeabilities for given flow rates and their corresponding flow pressures. The preferred method can further comprise the step of calculating a vertical and horizontal permeability. The preferred method further comprises repeating the five initial steps of the method at preselected sites within a formation and calculating a vertical and horizontal permeability.

One object of the present invention is to determine reservoir inflow performance during the drilling stage of well development.

Another object of the present invention is to determine vertical and horizontal permeabilities with a single well pressure transient test.

Another object of the present invention is to provide inflow information from formations displaying weak pore structure and relatively low formation pressure.

Other objects, advantages, and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention.

DESCRIPTION OF THE PREFERRED EMBODIMENT

(BEST MODES FOR CARRYING OUT THE INVENTION)

A testing method and apparatus for reservoir evaluations while drilling is described. An important feature of the technique is that the test can be conducted by making use of the drilling facilities; therefore, no extra operational costs are expected. The measurement while drilling (MWD) unit could be of help, but is not a prerequisite. The same test procedures may be performed at various degrees of wellbore penetration into the formation, hence, the vertical variations of permeabilities may be obtained.

The test consists of two major steps. First, a desired drawdown is induced by pumping a lighter fluid than the drilling fluid down the drillpipe and up the annulus. Upon obtaining a certain amount, for example 5–20 bbl of oil, the well is shut-in for a pressure buildup. A mathematical model is derived to predict pressure conditions associated with various stages of the test. The computer simulator based on the mathematical model enables prediction of flowing and shut-in bottom hole pressure and flow rates under the test conditions if the reservoir and wellbore data are known. Inversely, reservoir pressures and permeabilities may be retrieved for given flow rates and their corresponding flowing pressures. The test can be performed at any stage during a drilling operation after the formation is exposed by the drilling bit. It may be performed as soon as the top of the formation is encountered. This offers an advantage of testing a formation with minimized skin effect.

This method and apparatus are useful for early determination of well or reservoir inflow performance. Therefore, it will help to make decisions for the future well completion configuration and possible stimulation. Since both the vertical and horizontal permeabilities can be obtained in the course of testing, this technique can be used as a pre-screening method for selecting good horizontal well drilling prospects.

This testing method and apparatus are particularly suitable for formations displaying weak pore structure and relatively low formation pressure.

Figure 1:
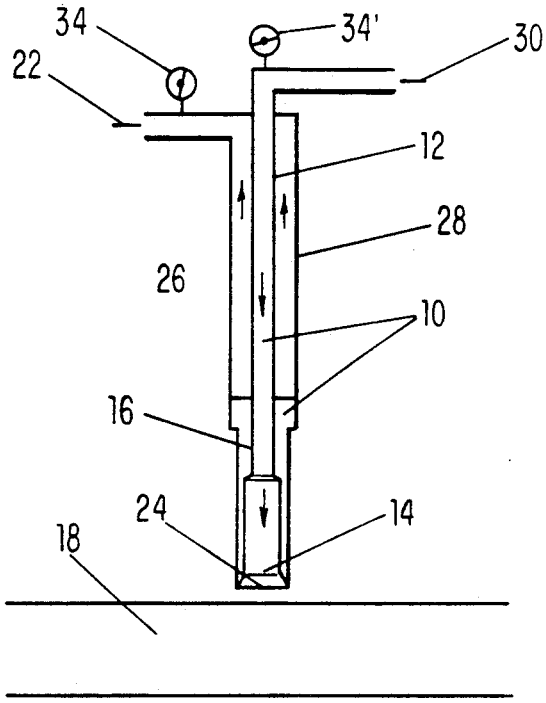
FIG. 1 is a diagram of the step of pumping the inducing fluid.
Figure 2:
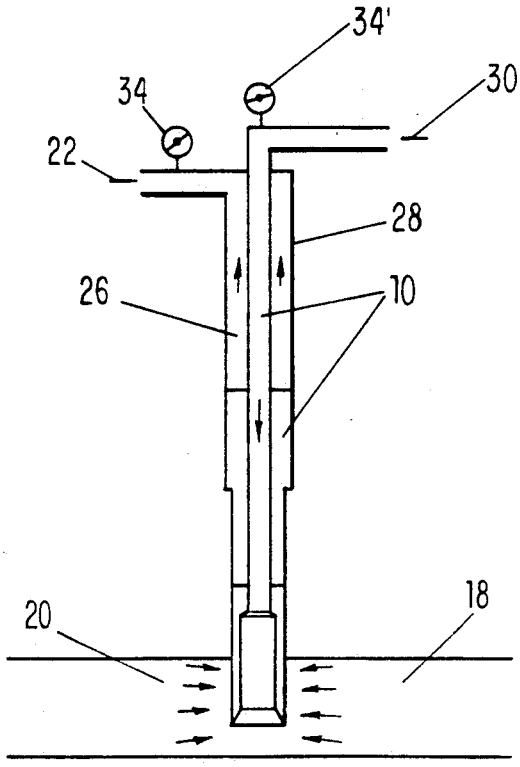
FIG. 2 is a diagram of the pressure drawdown step.

While approaching oil/gas bearing formation 18, a inducing fluid 10 with properly reduced density is circulated down drillpipe 12 and through bit 14 to annular space 16 as depicted in FIG. 1. This inducing fluid 10 is called an inducing fluid since its purpose is to produce pressure, underbalance i.e. the borehole pressure is lower than formation pressure, in the hole and subsequent formation or reservoir fluid influx 20. As inducing fluid 10 enters annular space 16, the flow may be choked at the surface by casing choke, or a similar apparatus 22 to maintain the pressure overbalance i.e., pressure in the borehole is greater than formation pressure at the bottom hole 24. With proper timing of the drilling rate and the rate of fluid circulation, oil/gas bearing formation 18 can be encountered with only a slight pressure overbalance. At this time, drilling is stopped and more inducing fluid 10 is pumped into the annulus 16. To induce formation fluid flow 20, a valve 22, such as casing choke or a like device is released and consequently bottom hole pressure decreases and so does drillpipe pressure. This step (pumping or inducing fluid) is not necessary if the borehole pressure during drilling is already lower than formation pore pressure. If the bottom hole 24 pressure is sufficiently reduced, the formation fluid flow 20 toward the wellbore begins (FIG. 2). This phase of the test is called the inflow process. Since drilling mud 26 is slightly compressible and the borehole size remains essentially constant, the increase in flow rate and volume at the surface should closely correlate with the amount of reservoir fluid 20 entering annulus 16.

Figure 3:
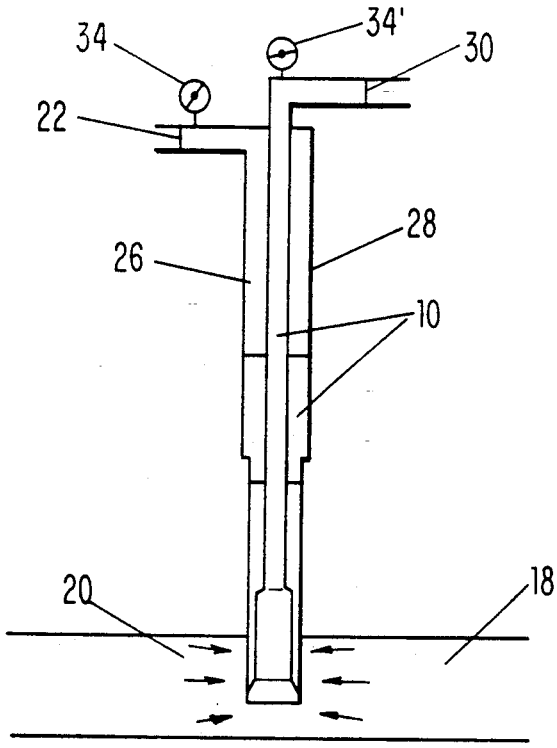
FIG. 3 is a diagram of the pressure buildup step.

After admitting a desired amount of reservoir fluid 20, well 28 is shut-in by closing surface chokes 22, blowout preventers or similar devices 22 and 30. Upon shutting in well 28, the pressure builds up (FIG. 3). This is called the shut-in process of the test. The shut-in pressures are measured both at casing and drill pipe 12 at the surface or at a predetermined depth by pressure measuring apparatuses 34 and 34'. Since drill pipe 12 contains fluid 10 of known density, the bottom hole 24 pressure can be calculated. If the downhole pressure measurements could be obtained rather than calculated, the accuracy of the test data interpretation will be improved. Upon completing the pressure buildup test, formation fluid 20 is circulated up to the surface and recovered for further analysis. This phase of the test is called the circulation process.

In the above described procedure, an assumption is introduced that the reservoir depth is known. If the depth of the reservoir is not known, it may be necessary to partially penetrate formation 18 before lighter fluid 10 is pumped into the hole to produce the desired pressure underbalance.

If the wellbore pressure is reduced intentionally by using the above mentioned technique, formation fluid 20 influx may theoretically occur from any open part of the hole above the formation under investigation. If such a situation would develop, the analysis of the test data would be difficult, if not impossible. This, however, is not likely to occur due to the plugging properties of drilling fluid 26. Very good practical evidence of drilling fluid 26 plugging properties is provided during tripping operations. While bit 14 is pulled out of the hole, rock bit 14 acts as a piston, creating the swabbing effect. It is documented that the borehole pressure while pulling out the drill string can fall considerably below the hydrostatic pressure. In spite of this reduction in borehole pressure, there is no formation fluid 20 influx into the hole. Of course, if such an influx would occur, then application of this technique may not be advisable, or special downhole equipment would be required. Such equipment is already available.

It is possible to produce the reduction in the borehole pressure required to initiate flow from the just encountered oil/gas bearing formation 18 while the other strata remain sealed off. It is also possible that if a useful technique for interpretation of the test results is found, the application of a downhole blowout preventer will become more popular and economical. While the actual procedures may vary for different wells, the test schedule involves four phases: (1) pumping induced fluid 10 down drill pipe 12 and up annular space 16 to produce pressure underbalance; (2) formation fluid 20 influx into the wellbore; (3) shutting-in well 28, hence, the pressure buildup; and (4) circulating formation fluid 20 out of the hole.

In order to obtain a meaningful set of data in quantity and quality as well as to conduct the test safely and efficiently, the test must be carefully designed. Assuming that all the required hardware is in place and functioning at the time of the inflow period, the amount of inducing fluid 10 and the desired amount of formation fluid 20 have to be precalculated. To perform the required calculations, the formation inflow performance must be estimated. A reasonable estimate is necessary to evaluate whether the test is feasible and executable. A close and effective cooperation between the drilling, reservoir, and geological personnel is of critical importance. It should also be well understood that the actual well test will not follow the pre-design schedule. However, the actual casing and drill pipe pressures and the amounts of fluid going into and flowing out of the hole will be recorded. The pressure transient analysis leading to determination of reservoir pressure and permeability will utilize the data recorded during the inflow and pressure build-up phases of the test.

EXAMPLE (INDUSTRIAL APPLICABILITY)

The invention is further illustrated by the following non-limiting example. The terms utilized are defined as follows:

English

- A -cross-section area, $ft^2$ ($L^2$).
- $B_o$-oil formation volume factor, rb/stb (dimensionless).
- c -total compressibility, 1/psi ($LT^2/M$).
- h -formation thickness, ft (L).
- k -permeability, md($L^2$).
- l -length of open portion of formation, ft (L).
- m -slope, psi ($M/LT^2$).
- $N_p$-pit gain, bbl ($L^3$).
- p -pressure, psi ($M/LT^2$).
- q -flow rate, bbl/day or gpm ($L^3/T$).
- r -radius, ft (L).
- t -time, hr (T).

Greek

- $\mu$-viscosity, cp (M/LT).
- $\rho$-density ($M/L^3$).
- $\phi$-porosity (dimensionless).

Subscript

- an -annulus.
- cs -casing.
- D -dimensionless.
- dp -drillpipe.
- ET -early time.
- $\int$-flow condition.
- h -hydrostatic.
- i -inducing fluid, or initial condition, or time related index.
- j -time related index.
- LT -late time.
- n -time related index.
- p -pump.
- r -reservoir fluid.
- s -shut-in condition.
- w -at wellbore.

As an example, a theoretical test is presented on an assumed formation 18 of FIG. 2, at a depth of 10,000 feet where a 12.25 inch hole is drilled about 20 feet into formation 18. An inducing fluid 10 with a density of 7.1 ppg is pumped at a rate of 300 gpm to replace original drilling fluid 26 with a density of 9.5 ppg. The initiation of the reservoir fluid influx 20 is detected after the inducing fluid 10 level in the annulus 16 reaches 3,252 feet above bottom of the hole 24. The drawdown process takes thirty minutes. After which, well 28 is shut in at the surface for thirty minutes.

Table 1 contains the drill pipe pressure, pit gain, and corresponding reservoir fluid flow rate during the drawdown period of the simulated test. The casing pressure is equal to the ambient pressure during the pumping and drawdown phases of the test. The flow rate is calculated as follows:

$$q_j = 24\left(\frac{N_{p,j} - N_{p,j-1}}{t_j - t_{j-1}}\right) \quad (1)$$

TABLE I

| t hour | $P_{dp}$ pti | $N_D$ bbl | q bbl/day |
|---|---|---|---|
| 0.017 | 1125 | 0.02 | 31.3 |
| 0.033 | 1118 | 0.05 | 54.7 |
| 0.055 | 1111 | 0.10 | 78.1 |
| 0.067 | 1103 | 0.16 | 101.6 |
| 0.083 | 1096 | 0.24 | 125.0 |
| 0.100 | 1088 | 0.34 | 148.4 |
| 0.177 | 1081 | 0.46 | 171.9 |
| 0.133 | 1073 | 0.59 | 195.3 |
| 0.150 | 1065 | 0.73 | 218.8 |
| 0.167 | 1058 | 0.90 | 242.2 |
| 0.183 | 1051 | 1.07 | 261.7 |
| 0.200 | 1043 | 1.27 | 285.2 |
| 0.217 | 1037 | 1.48 | 304.7 |
| 0.233 | 1029 | 1.70 | 328.1 |
| 0.250 | 1021 | 1.94 | 351.6 |
| 0.267 | 1014 | 2.20 | 375.0 |
| 0.283 | 1006 | 2.47 | 398.4 |
| 0.300 | 998 | 2.76 | 421.9 |
| 0.317 | 990 | 3.07 | 445.3 |
| 0.333 | 983 | 3.39 | 468.8 |
| 0.350 | 975 | 3.73 | 492.2 |
| 0.367 | 967 | 4.09 | 515.6 |
| 0.383 | 959 | 4.46 | 539.1 |
| 0.400 | 951 | 4.85 | 562.5 |
| 0.417 | 943 | 5.25 | 585.9 |
| 0.433 | 935 | 5.67 | 609.4 |
| 0.450 | 928 | 6.11 | 632.8 |
| 0.467 | 920 | 6.56 | 656.3 |
| 0.483 | 912 | 7.03 | 679.7 |
| 0.500 | 901 | 7.52 | 703.1 |

The shut-in drillpipe pressure versus shut-in time is given in Table 2.

TABLE 2

| Δt hour | $P_{dp}$ psi | Δt bbl | $P_{dp}$ bbl/day |
|---|---|---|---|
| 0.008 | 823.0 | 0.083 | 853.0 |
| 0.017 | 839.0 | 0.108 | 854.0 |
| 0.025 | 845.0 | 0.142 | 855.5 |
| 0.033 | 847.5 | 0.183 | 856.0 |
| 0.042 | 848.5 | 0.250 | 857.5 |
| 0.050 | 850.0 | 0.350 | 858.0 |
| 0.058 | 851.5 | 0.500 | 859.5 |
| 0.075 | 852.5 | | |

The following analysis shows how to determine (1) stabilized reservoir pressure ($p_1$); reservoir fluid mobility ($(k/\mu)$; and pay zone thickness (h). The following equations for shut-in drillpipe pressure are:

for early shut-in time:

$$p_{dp} = p_i - m_{ET}\sum_{j=1}^{n-1}(q_j - q_{j-1})\log(t_{n-1} - t_{j-1}) - p_h \quad (2)$$

for late shut-in time:

$$p_{dp} = p_i - m_{LT} \sum_{j=1}^{n-1} (q_j - q_{j-1}) \log(t_{n-1} - t_{j-1}) - p_h. \quad (3)$$

Figure 4:
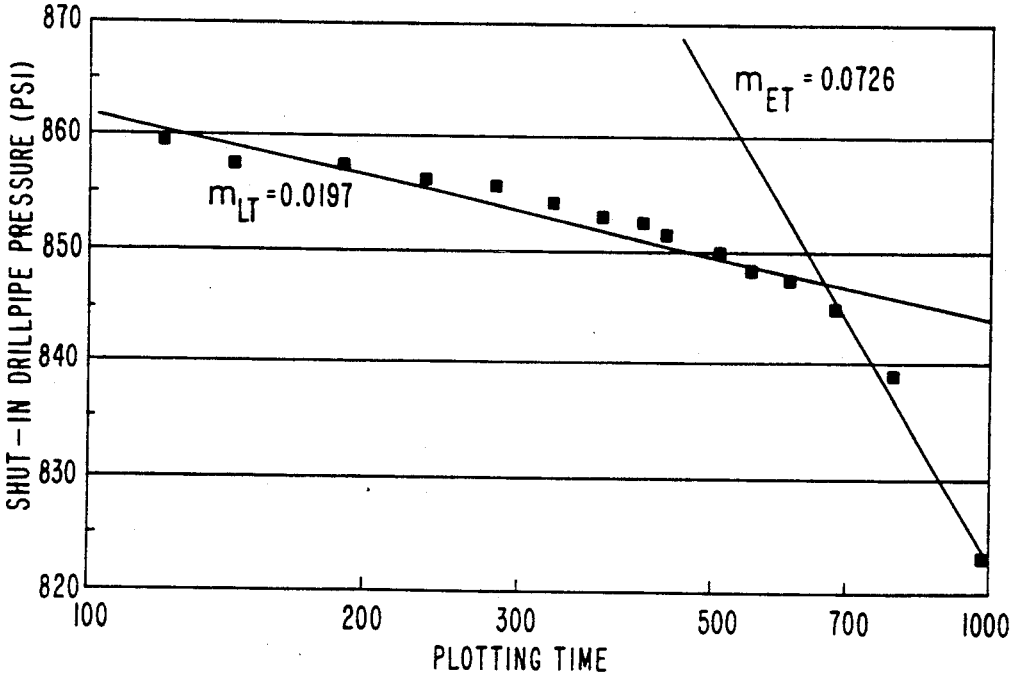
FIG. 4 is a graph of the pressure buildup data of the example.
Figure 5A:
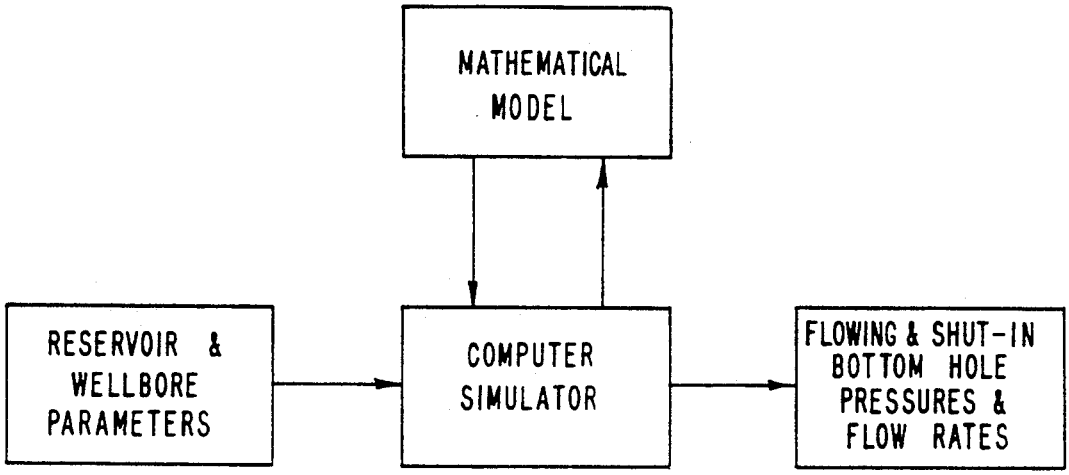
FIG. 5*a* is a diagram of the preferred method of predicting flowing and shut in bottom hole pressure and flow rates.
Figure 5B:
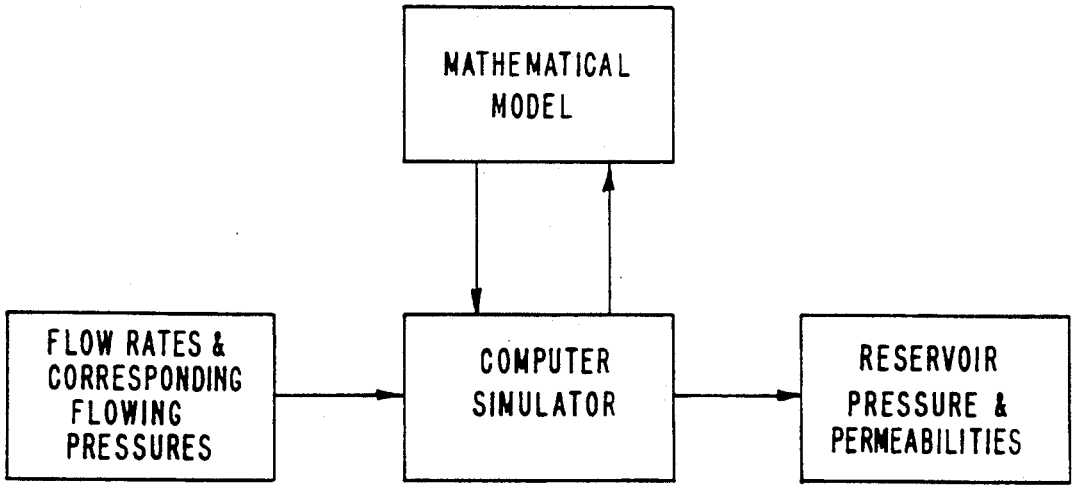
FIG. 5*b* is a diagram of the preferred method of determining reservoir pressure and permeabilities.

The plot of shut-in drillpipe pressure versus plotting time is shown in FIG. 4. Some scatter of data is observed; however, two segments of straight lines can be distinguished. The slopes are:

$$m_{ET}=0.0726,\ m_{LT}=0.0197. \quad (4)$$

Also the intercept, $p_{dp}(\Delta t \rightarrow \infty)=860$ psi. Since the drillpipe is entirely filled up with the inducing fluid, the hydrostatic pressure is 3700 psi, thus, the stabilized reservoir pressure is 4,560 psi. From the knowledge of the early slope, one can calculate:

$$\frac{k}{\mu} = 162.6 \frac{B_o}{lm_{ET}} = \frac{(162.6)(1.0)}{(20)(0.0726)} = 112 \text{ (md/cp)} \quad (5)$$

If, as first approximation, it is assumed $B_o - 1.0$, the fluid mobility is 112 (md/cp). The thickness of the formation is calculated as follows:

$$h = l\left(\frac{m_{ET}}{m_{LT}}\right) = 20\left(\frac{0.0726}{0.0197}\right) = 74 \text{ ft.} \quad (6)$$

Consequently, the basic reservoir parameters required for reservoir inflow performance analysis are determined.

In case the early data are masked by the wellbore storage effect, then only the late slope is known. Nevertheless, one may determine the formation transmissibility ($kh/\mu$).

Information provided in Table 1 can also be utilized to estimate the formation fluid mobility by performing the drawdown test analysis. To conduct this analysis one needs to calculate the flowing bottom hole pressures from the knowledge of the drillpipe pressures. If, of course, the flowing bottom hole pressure can be measured rather than calculated, the analysis would be more reliable.

Although the invention has been described with reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above, and of the corresponding application are hereby incorporated by reference.

What is claimed is:

1. A method of pressure-transient testing at the drilling stage of well development, the method comprising the steps of:
   a) providing a well
   b) creating a bottom hole pressure in the well lower than a formation pressure by inducing a drawdown comprising the steps of:
      i) pumping down a drillpipe and up an annulus an inducing fluid with a density less than a density of a drilling fluid; and
      ii) obtaining a predetermined amount of reservoir fluid from the annulus;
   c) determining a formation fluid rate from drilling fluid flow rate and volume;
   d) shutting-in the well;
   e) determining the bottom hole pressure in the well; and
   f) determining a reservoir inflow performance from the formation fluid rate and the bottom hole pressure.

2. The method of claim 1 wherein the step of inducing a drawdown comprises:
   a) pumping down the drillpipe and up the annulus the inducing fluid with a density less than the density of the drilling fluid while approaching a formation;
   b) stopping a flow of the drilling fluid as the inducing fluid enters the annulus to maintain the pressure in the bottom hole greater than the formation pressure;
   c) ceasing drilling when the formation is encountered;
   d) pumping additional inducing fluid into the annulus;
   e) releasing an annular pressure; and
   f) admitting a predetermined amount of reservoir fluid into the annulus.

3. The method of claim 2 wherein the step of stopping a flow of the drilling fluid comprises stopping the flow of the drilling fluid at a surface.

4. The method of claim 2 wherein the step of stopping a flow of the drilling fluid comprises stopping the flow of the drilling fluid at the bottom hole.

5. The method of claim 2 wherein the step of releasing an annular pressure comprises releasing valves on the drillpipe and casing.

6. The method of claim 1 wherein the step of shutting-in the well comprises closing valves on the drillpipe and casing.

7. The method of claim 1 wherein the step of determining a bottom hole pressure comprises measuring the bottom hole pressure.

8. The method of claim 1 wherein the step of determining a bottom hole pressure comprises measuring the pressure at predetermined locations in a casing and a drillpipe and calculating the bottom hole pressure.

9. The method of claim 1 wherein the step of determining a reservoir inflow comprises:
   a) providing a mathematical model to predict pressure conditions at preselected stages of a test;
   b) utilizing a computer simulator based on the mathematical model; and
   c) inputting the formation fluid rate data and the bottom hole pressure data into the computer simulator.

10. The method of claim 9 wherein the step of utilizing a computer simulator further comprises determining an approximate flowing bottom hole pressure, an approximate shut-in bottom hole pressure and an approximate flow rate formation fluid when reservoir depth, inducing fluid density, bottom hole pressure and wellbore dimensions are known.

11. The method of claim 9 wherein the step of utilizing a computer simulator further comprises determining approximate reservoir pressures and approximate permeabilities of a formation in the well for known formation fluid flow rates and corresponding flowing pressures.

12. The method of claim 1 wherein the step of determining a reservoir inflow performance comprises determining a vertical and a horizontal permeability of a formation.

13. The method of claim 1 further comprising the steps of:

f) repeating steps a) through d) at preselected sites within a formation; and g) calculating a vertical and a horizontal permeability at preselected sites within the formation.

14. An apparatus for pressure-transient testing at the drilling stage of well development comprising:

means for creating a bottom hole pressure lower than a formation pressure of a well comprising means for inducing a drawdown;

means for determining a formation fluid rate from predetermined reservoir and wellbore parameters;

means for shutting-in said well;

means for determining a bottom hole pressure of said well; and means for determining a reservoir inflow performance from said means for determining a formation fluid rate and said means for determining a bottom hole pressure.

15. The invention of claim 14 wherein the means for shutting-in a well comprises means for closing valves in a drillpipe and a casing.

16. The invention of claim 14 wherein the means for determining a bottom hole pressure comprises means for measuring pressure at predetermined locations in a casing and in a drill pipe and means for determining a bottom hole pressure from said measured pressures.

17. The invention of claim 14 wherein the means for determining the reservoir inflow performance comprises a means for utilizing downhole pressure parameters and flowing fluid parameters in a mathematical model means for predicting pressure conditions at preselected stages of a test and a computer simulator means based on said mathematical model means for determining flowing and shut-in bottom hole pressures and flow rates.

18. The invention of claim 14 wherein means for determining the reservoir inflow performance further comprising means for determining a vertical and a horizontal permeability of a formation in the well.

19. The invention of claim 14 wherein said means for determining a bottom hole pressure comprises means for measuring said bottom hole pressure.

20. The invention of claim 17 wherein means for determining the reservoir inflow performance further comprising means for determining reservoir pressures and permeabilities.

* * * * *